United States Patent [19]

Demetre

[11] 4,013,284

[45] Mar. 22, 1977

[54] DECURLER DEVICE

[75] Inventor: S. Gordon Demetre, Branford, Conn.

[73] Assignee: Eastern Graphic Products, Inc., New Haven, Conn.

[22] Filed: Oct. 14, 1975

[21] Appl. No.: 622,410

[52] U.S. Cl. ..... 271/183; 72/54; 72/160; 162/271; 271/63; 271/204; 271/208

[51] Int. Cl.[2] ..... B65H 29/04; B65H 29/70

[58] Field of Search ..... 271/183, 188, 204–206, 271/207–209, 229, 231, 63; 72/54, 160; 162/271, 270; 38/143; 226/195; 242/75.2

[56] References Cited

UNITED STATES PATENTS

| | | | |
|---|---|---|---|
| 2,852,255 | 9/1958 | Fischer | 271/94 |
| 3,076,492 | 2/1963 | Monks | 271/204 X |
| 3,684,277 | 8/1972 | Buschmann | 271/183 |
| 3,843,035 | 10/1974 | Fitterer et al. | 226/195 |

OTHER PUBLICATIONS

Gaylord, M.W. *Reinforced Plastics, Theory and Practice* Boston, Cahners, 1974, pp. 32–34, 131–134.

*Primary Examiner*—Evon C. Blunk
*Assistant Examiner*—Bruce H. Stoner, Jr.
*Attorney, Agent, or Firm*—Leydig, Voit, Osann, Mayer & Holt, Ltd.

[57] ABSTRACT

An improved decurler device, in the form of a rounded, substantially M-shaped vacuum bar, is provided for drawing curled sheet material into its rounded trough where a multiplicity of spaced vacuum openings are located thereby reversely bending the sheet and taking out the curl previously imparted to it. The bar is made of a reinforced plastic material with a hard and very smooth surface which wears well and does not scratch, mar or otherwise destruct the face of the sheet materials. A dispersion of fine carbon particles in the surface material of the bar is also effective to eliminate static electric charges built up in the sheet material incident to previous processing operations.

5 Claims, 5 Drawing Figures

DECURLER DEVICE

The present invention relates generally to sheet handling apparatus and more particularly concerns a decurling device for taking out the curl imparted to the sheet material incident to previous operations.

In the manufacture of paper, due to the normal fiber distribution pattern and orientation, there exists an inherent tendency to cause the paper to curl. In various sheet handling apparatus, this tendency is aggravated since the sheet material is caused to wrap around curved surfaces which, in combination with other operating parameters, causes the paper sheet material to curl. This is particularly true in the operation of printing presses, for example of the offset type, where the sheet material, though carried on the impression cylinder, tends to adhere to the moistened surface of the blanket cylinder. Since the leading edge of the sheet is clamped in the impression cylinder there is little tendency for the first part of the sheet to curl. However, as the sheet passes progressively through the printing couple, the tendency to curl increases. For this reason, and as those experienced in the printing art will recognize, this curling tendency is referred to as "tail-end hook". The amount of curl or tail-end hook is further influenced by the moisture content of the paper and the relative humidity of the surrounding atmosphere, the weight and type of the sheet material and the viscosity and coverage of the ink. Lighter weight paper tends to curl more and the tendency of the paper to curl increases with the viscosity of the ink as well as the area covered by the ink.

It will also be recognized by those skilled in the art that curled sheets create many subsequent handling problems. Thus it is difficult to get successive sheets to stack properly even if jogging equipment is employed. Improperly stacked sheets, of course, cause many additional problems in folding, cutting and binding equipment as well as registration difficulties if subsequent impressions are to be printed on the sheet material.

In view of the foregoing, various attempts have been made in the past to develop apparatus to take the curl out of sheet material. One approach is shown in U.S. Pat. No. 3,661,703 issued May 9, 1972 which employs a series of rolls about which a web is trained. Another approach is shown in U.S. Pat. No. 3,076,492 issued Feb. 5, 1963 which employs a vacuum trough having a continuous slot therein. In both of these patents the material being processed is given a reverse bend which, if properly regulated, removes the effect of the curl previously imparted. While the latter patent with its relatively shallow trough and open vacuum slot may be particularly suited for decurling paper sheet material laminated to a metal foil, it has not proven entirely satisfactory for decurling the wide range of unbacked paper stock normally used in the printing arts. Moreover, the metallic surfaces of such devices may become flawed or burred and leave scratches on the face of the subsequent sheets of material that are drawn across it. This is particularly objectionable when such a burr scratches the face of a previously printed sheet. Another objection to devices such as disclosed in the latter-mentioned patent is that as the trailing edge of the sheet material is drawn across the slot a very audible popping noise is generated and at high production speeds this is very irritating to the surrounding press room personnel. Also when light weight sheet is sucked into such a slot it tends to feather the end of the sheet.

Accordingly, it is the primary aim of the present invention to provide an improved decurler device which is effective for taking the curl out of substantially the entire range of paper stock material normally used in the printing arts.

It is a related and more specific object of the invention to provide an improved decurler bar which is so configured that it draws light weight sheet material substantially completely into a deep vacuum trough and thus provides maximum reverse bending action, but which draws increasingly heavier paper stock progressively less deeply into the trough and thereby diminishes the tendency to break the fiber surface of the heavier stock material.

It is also an object of the invention to provide a decurler device of the above type made of a reinforced plastic material with a very hard and smooth surface coating that wears well and does not tend to scratch the surface of the sheet material. A correlated object is to disperse minute carbon particles in the surface coating of the bar so that it is also effective to eliminate static electric charges which have been built up in the sheet material.

Finally, it is an object of the present invention to provide a decurling device with a configuration which continuously supports the trailing edge of the sheet material and thereby substantially reduces both the noise level and the tendency to feather the sheet ends even during high speed operation.

These and other objects and advantages of the invention will become apparent upon reading the following detailed description and upon reference to the drawings, in which.

While the invention will be disclosed in connection with certain preferred embodiments, it will be understood that I do not intend to limit the invention to those embodiments. On the contrary, I intend to cover all alternatives, modifications and equivalents as may be included within the spirit and scope of the invention as defined by the appended claims.

Figures 1, 2:
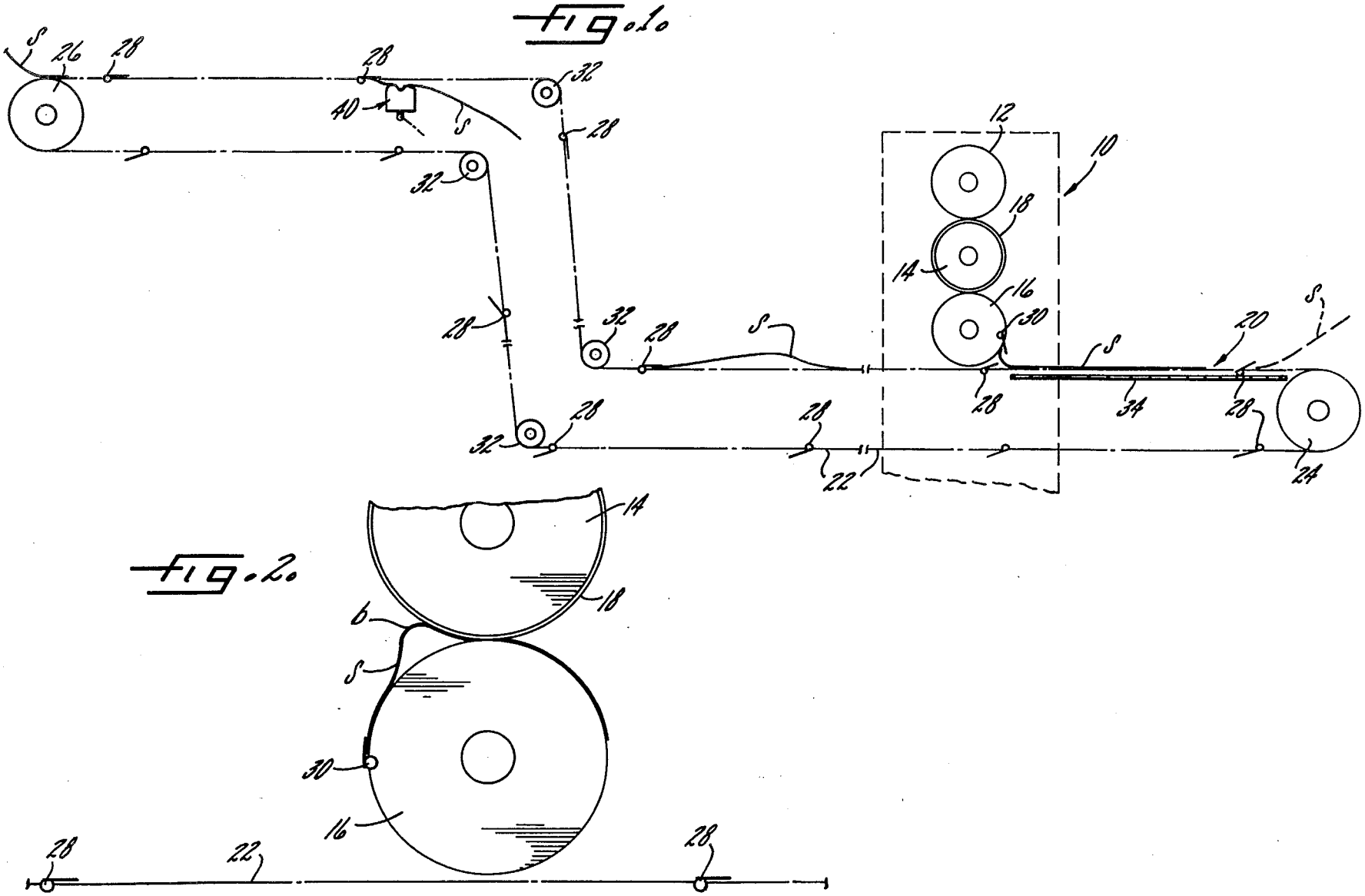
FIG. 1 is a schematic side elevation of a sheet handling apparatus incorporating the present invention in association with a printing press.
FIG. 2 is an enlarged fragmentary schematic view of the impression and blanket cylinders of the printing press with a sheet of material, in exaggerated form, passing therethrough.

Turning now to the drawings, there is shown in FIG. 1, in highly schematic form, a printing press 10 and a sheet feeding and delivery apparatus 20 with which the present invention is associated. In the illustrated embodiment, the printing press 10 is of the offset lithographic type and includes a plate cylinder 12, a blanket cylinder 14 and an impression cylinder 16. It will also be understood that the printing press 10 includes an ink supply and a dampening solution supply together with respective ink and dampening feed and form rollers (not shown) for transferring the ink and dampening solution to the plate cylinder 12 from their respective sources in a regulated and properly distributed manner. The ink impression on the lithograhic plate mounted on the plate cylinder 12 is transferred to a rubber blanket 18 which forms the surface of the blanket roll 14 and this image is then transferred to the surface of a sheet S of paper or the like drawn through the nip between the blanket cylinder 14 and the impression cylinder 16.

In schematic form, the sheet feeding and delivery apparatus 20 includes a pair of endless transport chains 22 disposed in parallel relation on either side of the press 10 (only one of which is shown) and trained in orbital fashion around a drive sprocket 24 and a driven sprocket 26. Mounted between the parallel chains 22 are a plurality of gripper bars 28 which receive the individual sheets S from a source (not shown) and deliver them to the impression cylinder 16 where they are released from the gripper bar 28 and fed into a clamping mechanism 30 on the impression cylinder 16. The sheet S is then carried by the impression cylinder 16 through the nip formed with the blanket cylinder 14 as the chains 22 continue to move to the left as seen in FIG. 1. The chains 22 are timed such that a subsequent gripper 28 passes adjacent the sheet clamping mechanism 30 on the impression cylinder as the cylinder carries the sheet S downwardly on the left-hand side of the press as seen in FIG. 1. The sheet S is then released by the clamping mechanism 30 and engaged by the subsequent gripper bar 28 which carries it through the initial delivery section extending to the left-hand side of the press 10.

As is common in many sheet delivery arrangements associated with printing presses, and as shown schematically in FIG. 1, the final delivery section is vertically offset from the initial delivery section. Accordingly, pairs of direction-reversing idle sprockets 32 are provided in both the forward and return reaches of the chains 22. To support the sheets S between the parallel chains 22 one or more plates or rails 34 are provided in the sheet feeding section. As the sheet S passes around the driven sprocket 26 in the delivery section the gripper bar 28 is opened and the sheet is discharged to a stacking mechanism (not shown) which deposits the sheet on the top of a stack of previously delivered sheets.

Referring now to FIG. 2, there is shown in exaggerated form a sheet S as it passes through the nip between the blanket cylinder 14 and the impression cylinder 16. Because of the ink on the rubber surface 18 of the blanket cylinder, the sheet S tends to adhere to the rubber blanket 18 after it leaves the nip of the rolls 14, 16. The sheet is then drawn downwardly by the clamping mechanism 30 on the impression roll 16 and this creates a bend *b* in the sheet S as it is pulled away from the blanket 18. It will be understood that the radius of this bend *b* depends on a number of things such as: the relative humidity of the paper; the pressure at the printing nip; the thickness of the paper; thinner paper being more flexible and thus taking a sharper bend; the viscosity of the ink; and, the relative area of the sheet covered by the ink, together with the inherent characteristics of the paper. The result of this bend *b* is to impart to the sheet S a curl which is progressively more pronounced toward the trailing edge of the sheet and is known in the art as "tail-end hook".

One such curled sheet S is shown, somewhat exaggerated, just to the left of center in FIG. 1. As those skilled in the art will appreciate, such curled sheets are difficult to stack and handle in subsequent sheet feeding operations. Non-aligned stacks of sheets also cause further problems in folding, cutting and binding equipment and cause registration difficulties if the curled sheets are to be printed with additional impressions.

In accordance with the present invention, an improved decurler device 40 is provided for the sheet handling apparatus 20 to take the curl out of the sheets S. As shown schematically in FIG. 1, the decurler device 40 is located below the forward reach of the chains 22 in the final delivery section following the upper direction-reversing sprockets 32. The gripper bars 28 are pivotally mounted between the side chains 22 and they pass above the decurler device 40 but the sheet material S swings down and is drawn across the top of the decurler device.

Figure 3:
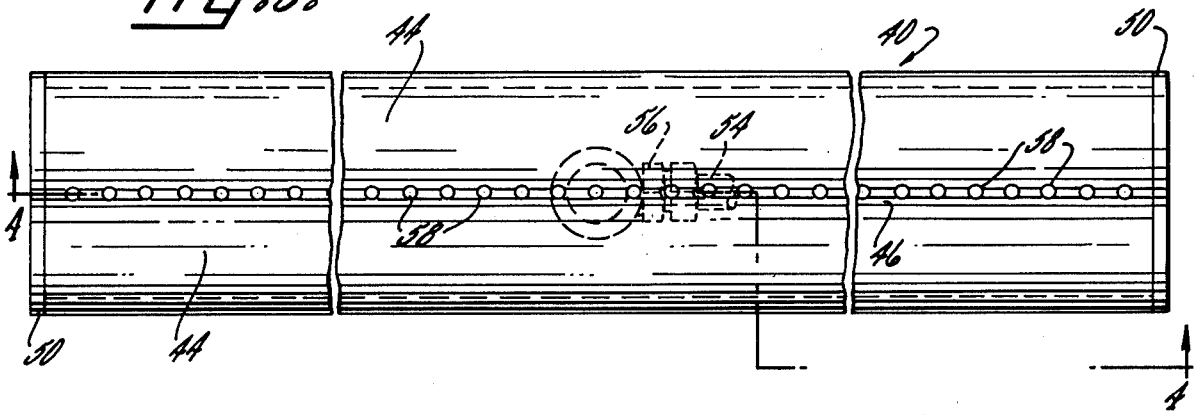
FIG. 3 is a plan view of the decurling device of the present invention.
Figure 4:
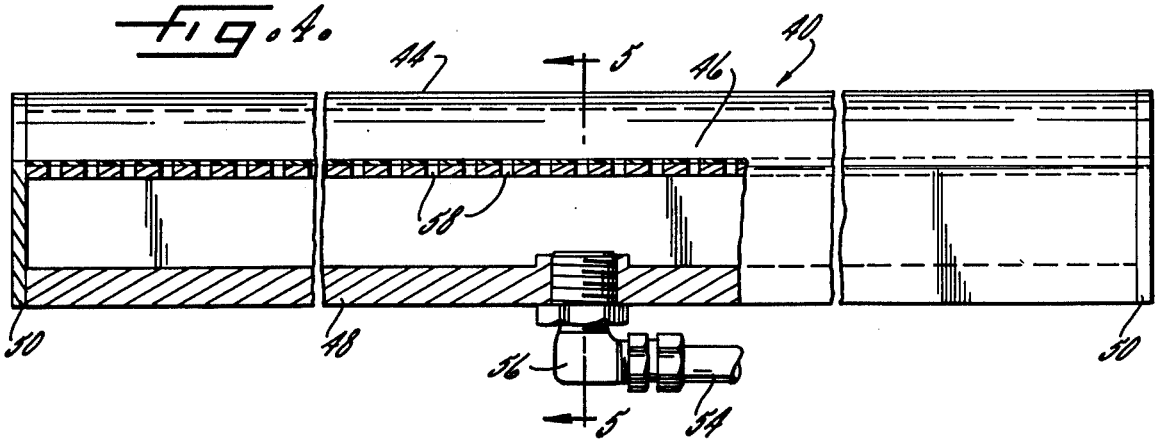
FIG. 4 is an illustration partly in section and partly in elevation as seen substantially along the lines 4—4 in FIG. 3; and, FIG. 5 is an enlarged section as seen substantially along line 5—5 in FIG. 4 and also including a schematic diagram of the vacuum source.
Figure 5:
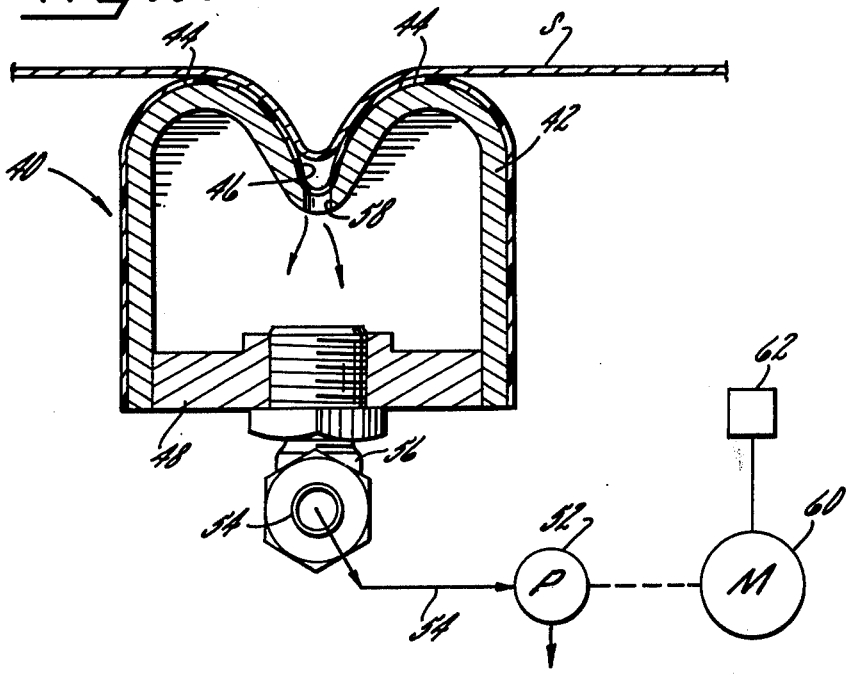

Referring also to FIGS. 3–5, the decurling device 40 includes an elongated suction bar 42 disposed across the delivery path substantially transverse to the direction of sheet movement. In the preferred embodiment and as shown in FIG. 5, the suction bar 42 has a substantially M-shaped cross section with two smoothly rounded crests 44 separated by a rounded U-shaped trough 48. A bottom panel 48 bridges the legs of the M-shaped bar 42 and the ends are closed by plates 50.

To draw the sheet S into the trough 46 of the bar 42 a vacuum pump 52 is coupled to the bar 42 through a conduit 54 and an end fitting 56 threaded into the bottom panel 48. As a vacuum is drawn by the pump 52, air is sucked into the bar 42 through a multiplicity of apertures 58 formed in the bottom of the trough 46. As the sheet S is pulled across the crests 44 by the gripper bar 28 the suction in the bar 42 pulls the sheet S into the trough 46 giving the sheet a reverse bend with respect to its original curl. In this connection, it will be noted that the curvature of the crests 44 is in the same direction as the curl of the sheets S and the radius of the rounded trough 46 is substantially less than the radius of the crests 44 so that as the sheet is drawn into the trough 46 by the vacuum it is progressively bent in a compound reverse curvature with the sharpest bend being opposite the original direction of curl.

A preferred form of the vacuum bar 42 has dimensions substantially as shown in FIGS. 3 and 4, i.e., an overall height and width of approximately 1 and ½ inches and with the apertures 58 being 5/64 inch in diameter and spaced on ¼ inch centers. While the apertures 58 extend substantially across the trough 46 as viewed in the direction of sheet movement, they occupy less than one-third of the length of the trough and the solid material in the bottom of the trough 46 supports the sheet S even when it is drawn fully into the trough. It has been found that this substantially eliminates the "popping" noise that is created when the trailing edge of a sheet is drawn across a continuous slot such as shown in FIG. 2 of the above-mentioned U.S. Pat. No. 3,076,492.

While FIG. 5 is a somewhat enlarged view, it will be seen that the depth of the trough 46 is substantially one-half the distance between the crests 44 along a line tangent to both crests. Moreover, the radii of the crests 44 are large relative to the radius of the trough 46 and in the preferred embodiment this ratio is greater than about 5 to 1. It will also be appreciated that the large interior cross section of the bar 42 serves as an equalizing manifold to distribute the vacuum substantially informly along the length of the bar so that the suction at each of the apertures 58 is about the same.

With a vacuum of about 20 inches Hg. drawn by the pump 52 the decurling device 40 of the present invention has been found to be effective in taking the curl out of paper sheet material varying in weight from about 40 lb. to 100 lb. per ream and over a wide range of press operating conditions. However, to make the decurling device 40 even more versatile it is also desirable to control the vacuum level. In the illustrated embodiment and as schematically shown in FIG. 5, this is accomplished by driving the vacuum pump 52 with a variable speed electric motor 60 under control of a regulator 62.

As previously mentioned, lighter weight sheet material tends to take on more curl than the heavier weight material—other conditions being equal. To take the curl out of such light weight material it is necessary to give it a relatively sharp bend as it crosses the suction bar 42 and thus it is drawn substantially completely into the trough 46. In contrast, if heavy weight sheets are given such a sharp bend the likelihood increases that it will "break the back" of the sheets or fracture the coating, if coated sheets are employed. Of course, the heavier sheet material bends less than light material and it has been found that a decurler device 40 having the parameters mentioned above provides a good balance for a wide range of sheet material and operating conditions.

Pursuant to another aspect of the present invention the vacuum bar 42 is preferably made of fiber glass reinforced plastic material provided with a smooth, hard wear resistant gel coat. In its preferred form, the bar 42 has a tensile strength of about 45,000 psi. with elongation of only about 2% and the gel coat has a Barcol hardness of about 43. The apertures 58 are preferably slightly countersunk at the bottom of the trough 46 and then given an additional light coat of the plastic gel coat material. The outer surface of the bar 42 may then be lightly polished with No. 600 grit sandpaper and water to leave an extremely smooth and "glossy" surface. The inside surface of the bar is also polished and waxed to prevent the accumulation of dust and paper particles from clogging the suction channel. In use it has been found that the surface of such bars 42 is substantially easier to initially prepare and maintain free from flaws than metal bars. It will be appreciated of course that even with expensive and sophisticated tooling and machining techniques it is extremely difficult to form metal parts having compound curvatures without leaving score lines, small burrs and other surface defects. Moreover, paper is abrasive and as the metal surface is worn other flaws and defects may be exposed. If a flaw or burr is exposed it may scratch the surface of sheets drawn across it. This is particularly objectionable if the sheet surface has been previously printed. In addition, such burrs, defects and score lines tend to trap and collect dust and other particles, and if these are abrasive, further scratching of the sheets occur. Not only is the hard plastic surface of the preferred bar 42 less subject to such flaws and defects, but it may also be more quickly and conveniently retouched when this is required. Thus, it may simply be sanded down with No. 600 grit sandpaper and water and then recoated with additional plastic gel coat material.

Finally, as a further feature of the present invention the gel coat (illustrated as a layer in FIG. 5) may contain a dispersion of fine carbon or graphite particles. The resulting di-electric properties of a bar 42 with such a coating has been found to be effective in eliminating the electrostatic charge that builds up in the paper sheet material as a result of prior handling operations. Thus, the bar 42 is not only capable of delivering flat, decurled sheets, but also, sheets that are essentially static free. Both of these factors, of course, contribute in making subsequent sheet handling operations much easier.

I claim as my invention:

1. An improved device for decurling curled sheets in a sheet handling apparatus having means for positively moving successive sheets along a delivery path comprising, in combination, an elongated suction bar disposed across the delivery path substantially transverse to the direction of sheet movement, said suction bar having a substantially M-shaped cross section with two smoothly rounded crests whose curvature is in the same direction as the curl of the sheets and a rounded U-shaped trough between said crests and having a multiplicity of apertures therein, means bridging the legs of said M-shaped cross section below said trough for forming a vacuum manifold closed except for said apertures, means for drawing a vacuum in said manifold, the radius of said trough being substantially less than the radius of said crests so that as a curled sheet is moved across said crests and drawn into said trough by said vacuum it is progressively bent in a compound reverse curvature the sharpest bend of which is opposite the original direction of curl, and said crests and trough being coated with a smooth, hard plastic gel coat containing a dispersion of fine carbon particles and said bar having di-electric properties to electrically destaticize said sheets.

2. An improved decurler device as defined in claim 1 wherein the ratio of the radii of said crests to the radius of said trough is greater than about 5 to 1.

3. An improved decurler device as defined in claim 2 wherein the depth of said trough is substantially equal to one-half the span between the said crests along a line of common tangency thereto.

4. An improved decurler device as defined in claim 1 wherein said apertures are slightly countersunk in the bottom of said trough and occupy less than about one-third of the length of said trough and extend substantially completely across said trough as viewed in the direction of sheet movement.

5. An improved decurler device as defined in claim 1 wherein the inside surface of said vacuum manifold is polished and waxed to prevent the accumulation of dust and particles from clogging said manifold.

* * * * *